US006113501A

United States Patent [19]

Richards

[11] Patent Number: 6,113,501

[45] Date of Patent: Sep. 5, 2000

[54] BILLIARD CUE STICK ACCESSORY

[76] Inventor: James M. Richards, P.O. Box 132, Accokeek, Md. 20607

[21] Appl. No.: 09/069,093

[22] Filed: Apr. 29, 1998

[51] Int. Cl.[7] ..... A63D 15/08

[52] U.S. Cl. ..... 473/46; 473/2

[58] Field of Search ..... 473/2, 49, 46, 473/45, 47

[56] References Cited

U.S. PATENT DOCUMENTS

| | | | |
|---|---|---|---|
| 370,911 | 10/1887 | Weber | 473/47 |
| 507,471 | 10/1893 | Barger | 473/36 |
| 514,420 | 2/1894 | Jacobus | 473/564 |
| 529,731 | 11/1894 | Gschwendtner | 473/43 |
| 692,970 | 2/1902 | Zaehringer | 473/47 |
| 829,749 | 8/1906 | Adjorjan | 473/36 |
| 2,379,006 | 6/1945 | Johnson | 473/568 |
| 2,608,409 | 8/1952 | Pinkerton | 473/256 |
| 3,116,926 | 1/1964 | Owen et al. | 473/457 |
| 3,342,489 | 9/1967 | Waldo | 473/47 |
| 3,521,883 | 7/1970 | Hamilton | 473/437 |
| 3,534,959 | 10/1970 | Elswick | 473/43 |
| 4,260,150 | 4/1981 | Tabet | 473/437 |
| 4,526,370 | 7/1985 | Mortellacci | 473/45 |
| 5,290,030 | 3/1994 | Medbury | 473/47 |
| 5,326,329 | 7/1994 | Doss | 473/47 |

*Primary Examiner*—Jeanette Chapman
*Assistant Examiner*—M. Chambers
*Attorney, Agent, or Firm*—William H. Holt

[57] ABSTRACT

A cue stick for billiards or pool and the like, is provided with a tubular, or ring like weight for adding mass during use for transferring greater energy to a cue ball. The weight may be provided with different sized openings for adjustably positioning the weight closer to or farther away from one end of the cue stick.

1 Claim, 1 Drawing Sheet

BILLIARD CUE STICK ACCESSORY

BACKGROUND OF THE INVENTION

This invention relates to a new accessory for use in connection with a conventional billiard cue, or cue stick, or which may also be referred to as a pool cue. Such a cue, or stick, is used for practising the sport of billiards, or pool, or snooker, or similar games of sport usually played upon a billiard table, or pool table or snooker table.

SUMMARY OF THE INVENTION

The invention relates to an accessory in the form of a tubular member which is of a size and configuration for being slid onto and off of a convention billiard cue stick for adding additional weight thereto. The weight may be used by a player, at the beginning of a game, during that part of the game referred to as "the break", for creating kinetic energy that is transferred from the cue to the cue ball to improve the efficiency of the break. The novel weight may be easily slipped onto the cue stick whenever desired by the player. Further, since the weight is tubular in shape, the central opening therethrough may be slightly tapered so that the positioning of the weight upon the cue stick can be made adjustable by choosing which end of the weight is located the greatest distance from the tip of the cue.

DESCRIPTION OF THE PREFERRED EMBODIMENT

Figure 1:
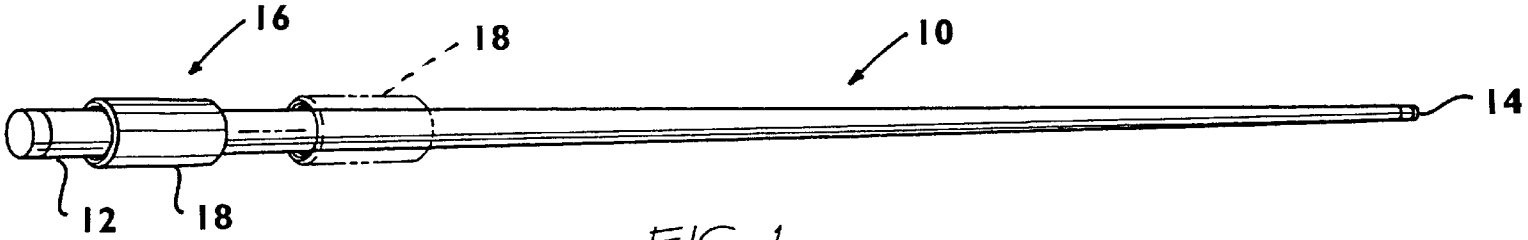
FIG. 1 is a perspective view of a conventional billiard cue stick and shows a tubular member comprising a weight which is formed in accordance with the invention, the weight being located near the butt end of the cue stick. Also illustrated, in phantom lines, is a tubular weight which is located at a position further from the butt end.

As is illustrated in FIG. 1, this invention relates to a novel accessory for a billiard cue, or cue stick, generally indicated by the numeral 10, which is comprised of an elongated, tapered stick having an enlarged butt end 12 and a small cue tip 14 affixed at the other end. A weight, generally indicated by the numeral 16, in the form of a tubular member 18 is slidably positionable upon the cue stick 10 by inserting the cue stick through a longitudinal opening that extends through the weight 16. The butt end 12 is too large to pass completely through the tubular member 18 thus resulting in the weight being positioned as shown in FIG. 1 at a location which is usually behind a player's hand during use. It is contemplated that the weight 16 can be formed of metal, or wood, or plastic but it is presently preferred that the weight 16 be formed of metal, such as steel, and be on the order of 4.5 inches long, with an outside diameter of approximately 1.5 inches and an inside diameter of approximately 1.25 inches; as will be more fully explained hereafter, the inside diameter can be varied in order to provide a smaller opening at one of tubular member 18 to provide for mounting the weight 16 further from the butt end 12, as is shown in dotted lines in FIG. 1. This feature of the invention provides a slightly different balance to the cue stick 10, at the option of the user.

FIGS. 2–5 illustrate several embodiments of weights which comprise the invention.

Figure 2:
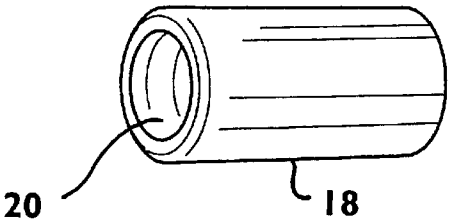
FIG. 2 is a perspective view of one embodiment in the shape of a substantially cylindrically shaped tubular weight formed in accordance with the invention.

FIG. 2 shows a first style of weight 16 which is formed as a tubular member 18 and which is encased in, or coated with a layer of plastic which provides protection against possible damage to the cue stick 10 where the two articles come into contact with each other. A central longitudinal opening 20 extends through the tubular member and allows for placing the weight 16 upon the cue stick 10 by sliding the weight 16 over the cue tip 14 and down toward the butt end 12 until the leading edge of the weight 16 comes into contact with the cue stick 10.

Figure 3:
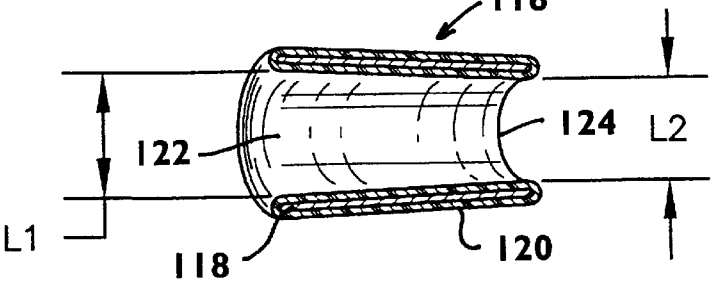
FIG. 3 is a fragmentary, sectional view, of one embodiment of the invention wherein a polymer material coating is applied to a tubular core member.

Referring to FIG. 3, it will be seen that a second form of the invention is comprised of a weight 116 which is formed of a central tubular member 118, which may be of metal or the like, and which has a plastic coating 120 both inside and on the outside. The weight 116 includes a relatively large first end 122 shown by dimension L1 and a smaller second end 124 shown by the dimension L2. This difference is openings at the opposite ends of weight 116 is readily provided by making the thickness of coating 120 slightly thinner at the first end 122 thus resulting in a slightly larger opening than at end 124. The difference in the size of the openings provides for the adjustability shown in FIG. 1 between the solid line showing and the dotted line showing of the tubular member 18.

Figure 4:
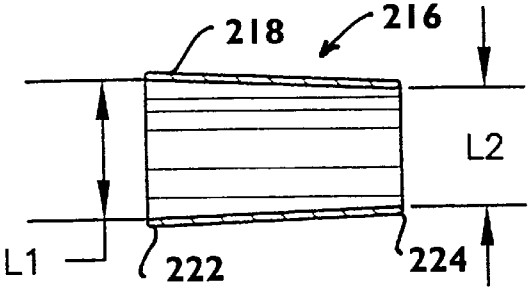
FIG. 4 is a sectional view of another embodiment of the invention showing a tubular weight having a longitudinal opening being tapered along its length to provide adjustibility along the length of the cue, as is illustrated in FIG. 1.

FIG. 4 shows a further embodiment of weight 216 which is comprised of a tubular member 218 that is formed with a taper that results in the openings at one end 222 being slightly larger than at the other end 224. Again, the difference in the size of the openings provides for the adjustment feature shown in FIG. 1.

Figure 5:
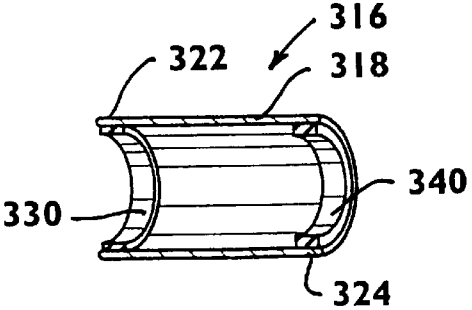
FIG. 5 is a fragmentary, sectional view of a further embodiment of the invention and illustrates different thicknesses of polymer material, or rubber-like ring members, preferably of different thicknesses for providing adjustability of positioning the weight upon the cue of FIG. 1, and also for providing cushioning material for protecting the cue against being damaged by the ends of the weight.

A still further embodiment of the invention is shown by weight 316 in FIG. 5. In this form, a cylindrical tubular member 318 has a pair of ring members 330 and 340 adhered to the inside marginal end portions of first end 322 and 324. As is clearly shown in FIG. 5, the ring member 330 is thinner than the ring member 340, thus resulting in the opening at end 322 being larger than the opening at end 324. Hereagain, the difference in the size of the openings provides the adjustability factor shown in FIG. 1.

It will be understood that the foregoing descriptions of the various embodiments are illustrative of the invention as presently contemplated and are subject to other modifications without violating the spirit and scope of the invention as defined by the following claimed subject matter.

I claim:

1. In combination, a conventional pool cue and a weight device, said weight device being removable from said conventional pool cue; said weight device consisting of a weight positioned along a rear and widest section of said conventional pool cue; wherein said weight has a mass which is distributed substantially symmetrical about one axis; wherein the weight comprises a truncated cone having a conical hole through said truncated cone, said conical hole having an axis of rotation which substantially coincides with the axis of rotation of the truncated cone; wherein the said conical hole having a minimum width smaller than the widest section of the said conventional pool cue; said weight being placed on said conventional pool cue in firm contact with said conventional pool cue; said weight being held on said conventional pool cue at least in part through a wedging action existing between a sloping circumferential surface of said conventional pool cue and at least part of an inner peripheral surface defining said conical hole passing through the said weight wherein there is further provided an outer shell which at least partially covers said weight; wherein said weight consists of a dense material and said outer shell consists of a polymer material.

* * * * *